US007878368B2

(12) United States Patent
Friesen et al.

(10) Patent No.: US 7,878,368 B2
(45) Date of Patent: Feb. 1, 2011

(54) CENTER PULL TOWEL DISPENSER METHOD AND APPARATUS

(75) Inventors: Matthew Friesen, White Rock (CA); Brad Friesen, Vancouver (CA); John Friesen, Vancouver (CA); Andrew Jackman, Langley (CA); Alex Tramploski, Richmond (CA)

(73) Assignee: Dispensing Dynamics International, Ltd., Surrey, BC (CA)

( * ) Notice: Subject to any disclaimer, the term of this patent is extended or adjusted under 35 U.S.C. 154(b) by 700 days.

(21) Appl. No.: 11/839,804

(22) Filed: Aug. 16, 2007

(65) Prior Publication Data

US 2009/0045211 A1 Feb. 19, 2009

(51) Int. Cl.
*A47K 10/24* (2006.01)

(52) U.S. Cl. ..... 221/45; 221/46; 221/62; 221/44

(58) Field of Classification Search ..... 221/45, 221/44, 304, 241, 33, 63, 41, 46, 49, 62
See application file for complete search history.

(56) References Cited

U.S. PATENT DOCUMENTS 5,765,718 A * 6/1998 Grasso et al. ..... 221/62
6,267,321 B1 * 7/2001 Tramontina ..... 242/593
6,510,964 B2 1/2003 Paukov et al.
6,592,001 B2 * 7/2003 Lewis et al. ..... 221/33
6,769,589 B2 8/2004 Paukov
6,869,041 B1 * 3/2005 Allegre et al. ..... 242/593
7,040,568 B2 * 5/2006 Lewis et al. ..... 242/593
7,131,609 B1 * 11/2006 Lewis et al. ..... 242/593
7,275,672 B2 * 10/2007 Haen et al. ..... 225/106
7,287,720 B1 * 10/2007 Allegre et al. ..... 242/593
7,510,137 B2 * 3/2009 Tramontina et al. ..... 242/593
2005/0067424 A1 * 3/2005 Duff ..... 221/63

* cited by examiner

*Primary Examiner*—Gene Crawford
*Assistant Examiner*—Michael K Collins
(74) *Attorney, Agent, or Firm*—Dwayne E. Rogge; Hughes Law Firm, PLLC

(57) ABSTRACT

A center pull towel mechanism having an adjustable iris system where a locking system is configured to enclose the surfaces defining the towel iris. In one form the adjustable iris system automatically adjusts the cross-sectional opening with an adjustable member positioned in the transverse rearward portion with respect to the towlette members interposed therein.

29 Claims, 13 Drawing Sheets

CENTER PULL TOWEL DISPENSER METHOD AND APPARATUS

BACKGROUND OF THE DISCLOSURE

Straight pull towel dispensing mechanisms have been utilized to allow dispensing of rolled paper towels which have perforations at prescribed lateral locations. Oftentimes a straight pull apparatus extracts the towel members from an inner open cylindrical area of the towel where the paper towel folds to a lower opening passing therethrough. A certain amount of friction acting upon the paper towel will break the perforation and one of the towel members will disengage from the roll of towels and a portion of the adjacent upper towel member will protrude through the opening of the towel dispensing apparatus.

Oftentimes paper quality and the general qualities of the paper have a tendency to provide different dynamics of the tearing action. For example, in some cases the paper may be thicker or the fiber matrix itself may be stronger. Further, the type of perforations can differ in cut length and attachment length in the lateral direction. In particular, the thickness of the paper towel will create a different cross-sectional area where the towel member is folded up and passing through the lower opening of a towel dispensing apparatus.

In the original center pull designs, a dispenser used in hard roll of towels and pulled the paper up through the center through an eye of a hole, and it was difficult to load because the user needed two hands to load the item by threading the paper from the top and pulling it out through the lower hole in the bottom. Oftentimes, a janitor will hold the item between his shoulder and cheek so he can use both hands to push the lower hole into the casing and have one hand free to feed the hole and pull the paper out of the bottom portion while simultaneously trying to finesse the entire roll into a holding place within the casing. Oftentimes the orifice was a fixed size, so if there was any issue with the quality or thickness of the paper or the change in the idiosyncrasies, there were problems related to tearing at a proper length to have a rather short extended tail or one which is too long.

A second generation of center pull towels included two improvements. One was a split funnel that rotated such that instead of placing in the material in a hole, there was a split and the janitor could place the material in the split. Thereafter, in the back portion of the unit, the unit can be adjusted. Because the adjustment member was in the rearward portion, this made the process very inconvenient and increased difficulty in determining which direction of rotation would tighten the orifice.

Further, paper is very abrasive and orifices tend to wear, such that an adjustment of an orifice may need to be performed in some forms during the use of a paper towel roll.

As disclosed herein, there is an embodiment involving fine-tuning the orifice setting in the front portion of the unit when the unit is open. Further disclosed is an automatic tension setting.

Therefore, there is a need for an improved adjustment of the opening where an iris adjustment system can provide a system for a closing the iris after a person maintaining the paper towel dispensing unit has placed a roll of paper towels therein. Disclosed herein is a method and apparatus for enclosing an adjustable iris to provide a more consistent towel breaking so a sufficient amount of towel extends out of the apparatus for a second withdrawal of a perforated towel section.

SUMMARY OF THE DISCLOSURE

Disclosed herein is a towel dispenser having a casing which has a mounting portion, a base region and a panel region movable attached to the base region. The base region also has a surface defining an access slot. An iris adjusting system is provided having an iris adjustment member comprising an adjustable iris surface which defines in part a towel iris. The iris adjustment system operatively configured to reposition the iris adjustment member to reposition the adjustable iris surface to change the cross-sectional area of the towel iris from within the chamber of the casing.

There is further an iris locking system front transverse surface portion and a surface defining a front slot opening. The front slot opening has an open orientation where the slot opening is in alignment with the access slot of the casing to provide access to the towel iris, and the transverse front surface has a closed orientation to discontinue communication between the axis slot of the casing and the towel iris where the transverse front surface is repositioned by way of an engagement surface of the iris locking system which is configured to engage the panel region of the casing and reposition the transverse front surface to the closed position with respect to the base region of the casing.

In one form the iris adjustment member is pivotally attached to the casing and a biasing member biases the iris adjustment member so the towel iris has a minimum cross-sectional area. In this embodiment the iris adjustment member can be pivotally attached to the base region of the casing and a shroud defines the transverse front surface and substantially encases the iris adjustment member in the circumferential region thereof and an engagement latch of the shroud defines the engagement surface and is operatively configured to engage the panel region of the casing when the panel region is in a closed position with respect to the base region. In one form the iris adjustment member comprises a biasing surface which is configured to engage a receiving surface of the shroud where the biasing surface of the iris adjustment member places an opposing force against the force of the engagement latch from the panel region of the casing when the panel region is in the enclosed position with respect to the base region of the casing.

One form of repositioning the front engagement surface is where the panel region is configured to engage the engagement latch of the shroud which rotates the shroud opening to the closed orientation when the panel region of the casing is in engagement with the base region to form an enclosed position.

In a preferred form the panel region is pivotally attached to the base region and the surface defining the slot opening is facing a transverse outward region. The iris adjustment system can have a lock extension at an opposing region of a pivot extension to pivotally connect the iris adjustable member.

Therefore, it can be appreciated that in one form of the disclosure a center pull towel dispenser is provided with an adjustable iris surface positioned in a transverse rearward portion of the towel iris (the portion positioned away from the user) to provide a transverse front surface for the towel to slide against when being pulled from the dispenser. The towel iris is essentially an opening defined by surrounding surfaces where the iris has a degree of adjustability of its open cross-sectional area. The substantially static transverse front surface defines, in part, the towel iris and in one form is provided with an open orientation when a front panel is in an open orientation to provide access to the towel iris for various purposes such as replacing, installing or otherwise modifying a paper towel positioned in the towel dispenser. Of course there can be many forms of a self adjusting iris adjustment system as well as a manual iris adjusting system.

Other details of one form of carrying out the broadly protected concept are disclosed further herein.

DESCRIPTION OF THE PREFERRED EMBODIMENTS

Figure 1:
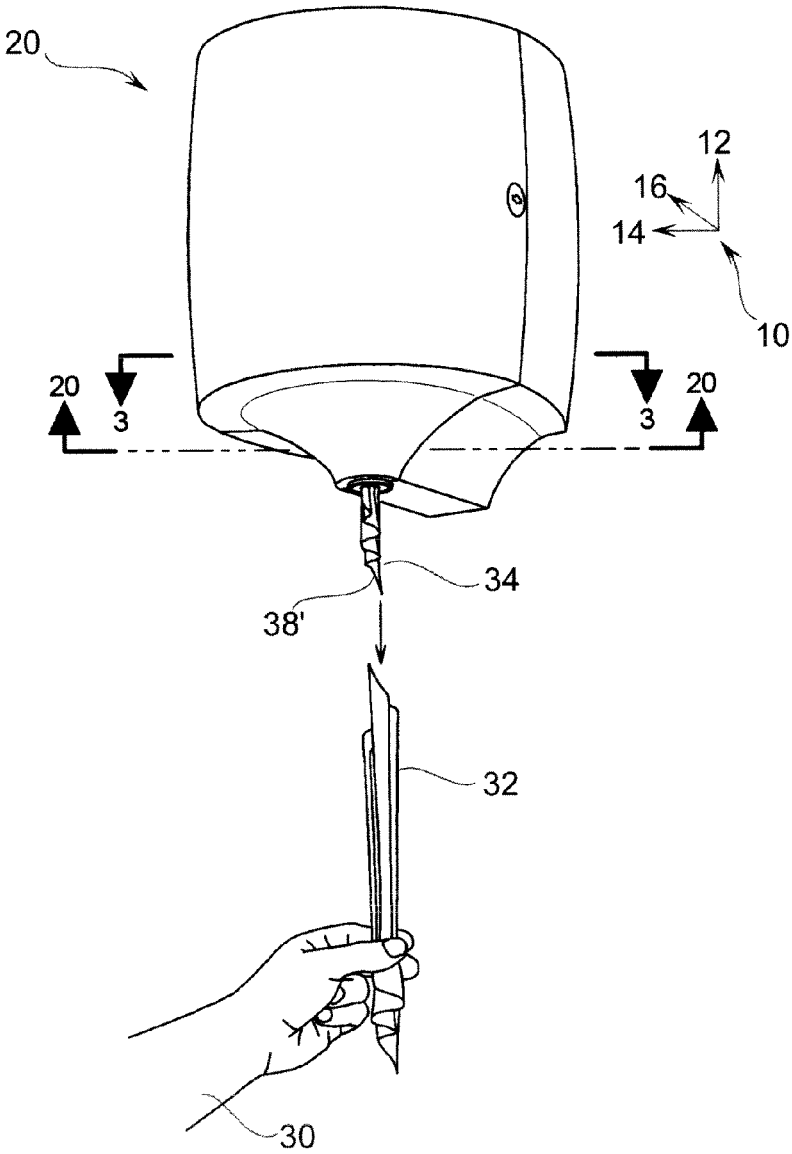
FIG. 1 shows an environmental view where the paper towel dispenser is shown where the individual is withdrawing a towlette member therefrom.

As shown in FIG. 1, there is an environmental view of the paper towel dispenser 20 which is an improvement over the disclosures U.S. Pat. Nos. 6,510,964 and 6,769,589 which are incorporated by reference. To aid in the description of the drawings, the axes system 10 is defined where the axis 12 indicates a vertical axis pointing a vertical direction and the axis 14 represents a lateral axis, where based from the transverse front portion of the paper towel dispenser 20, the axis 14 is pointing in the left direction with a substantially opposing direction in the right direction. Finally, the axis 16 indicates a transverse direction and points in a transverse forward direction (the opposing direction being a transverse rearward direction). Of course, the axes are for general reference purposes to aid in the description and orientation of the components described herein.

Figure 2:
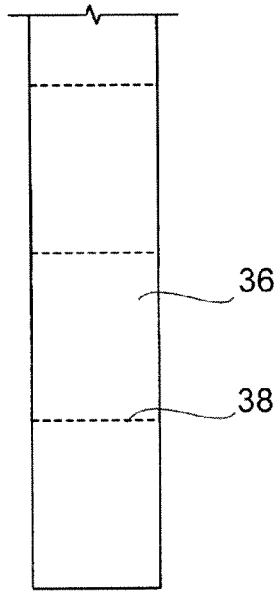
FIG. 2 shows a front view of an example of a ream of paper towel material illustrating the various perforations separating each towel section.
Figure 3:
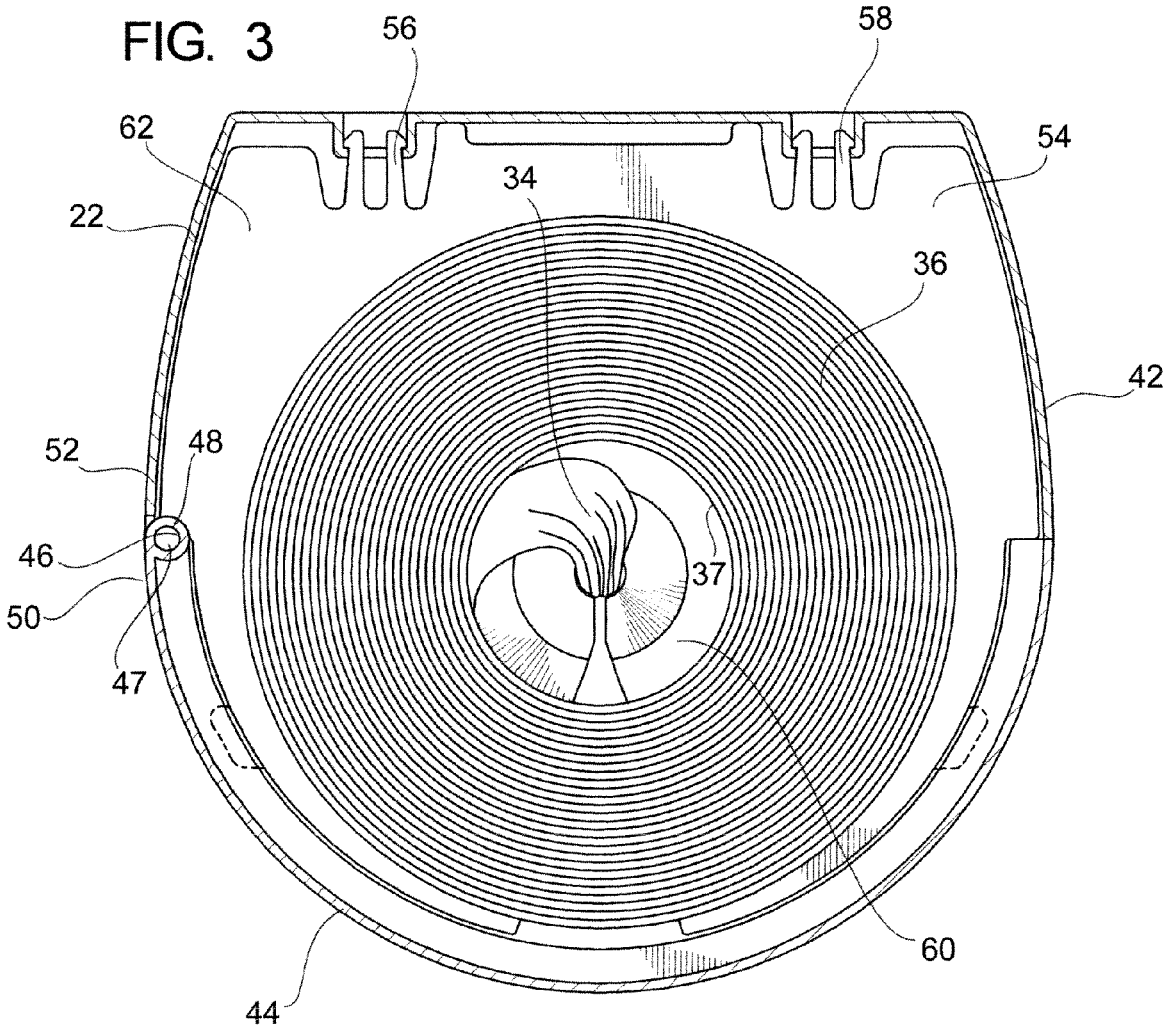
FIG. 3 shows a top cross sectional view taken at line 3-3 of FIG. 1 showing the mechanism dispensing towel at the center portion thereof.
Figure 7:
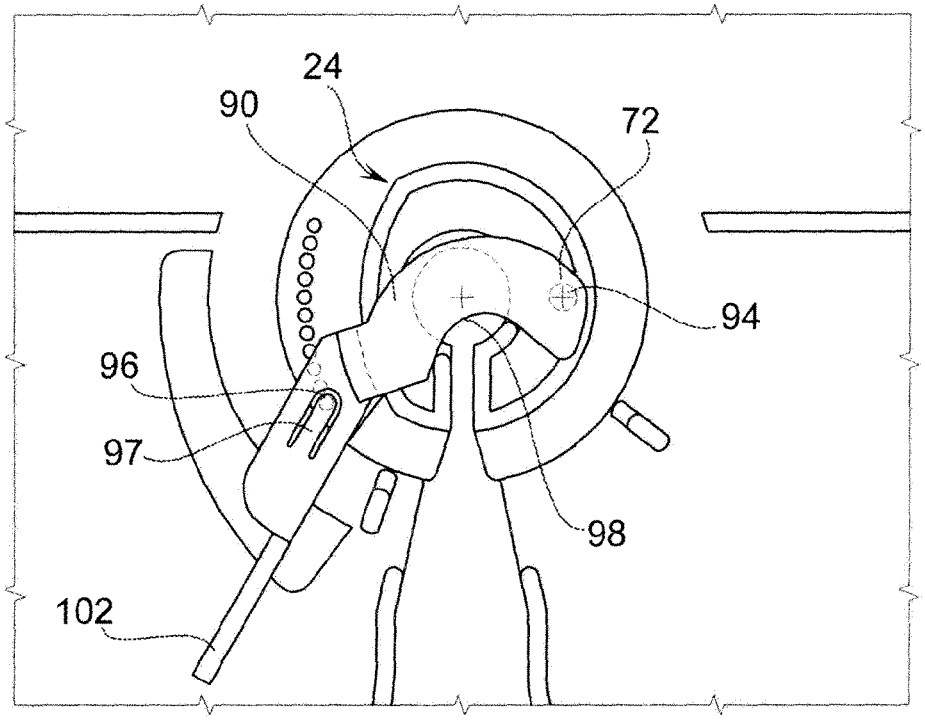
FIG. 7 shows the first embodiment where the manual iris adjustment member is in a more closed orientation.
Figure 8:
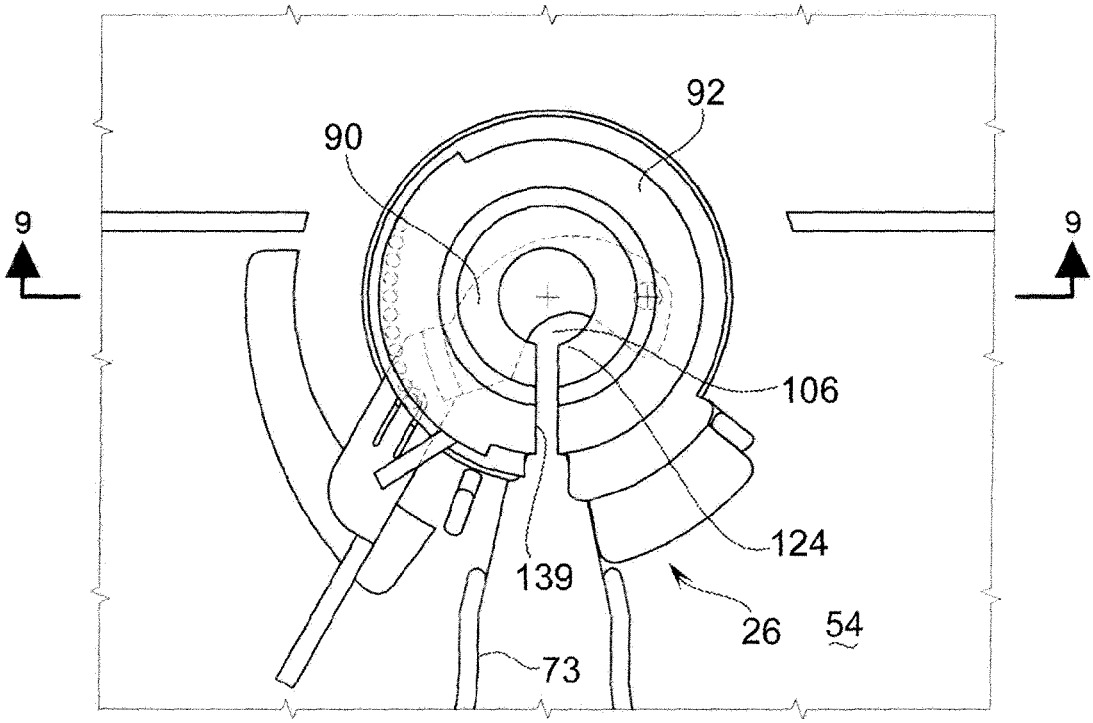
FIG. 8 shows the shroud member positioned around the iris adjustment member.

The paper towel dispenser 20 generally comprises a casing 22 as shown in FIG. 3, an iris adjustment system 24 as shown in FIG. 7, and an iris locking system 26 as shown in FIG. 8. Referring back to FIG. 1 there is shown the environmental view of FIG. 1 where the individual 30 is pulling on a towlette 32 which has broken away from the base frame end portion 34. As shown in FIG. 2, the ream 36 is shown where a plurality of perforations 38 separate each towlette member. FIG. 3 shows the ream 36 in a conventional wound-up manner. The end portion 34 generally comes from the inner conduit portion 37. It should be noted, as shown in FIG. 1, that commonly the broken perforation region 38' is of an oblique nature because, as shown in FIG. 3, the end portion 34 is dispensed from the towel iris 106 to the top and in general the bottom region will pass through the towel iris 106 to enhance the associated perforation while it passes through. As described herein, the towel iris 106 is adjustable and further locked in place by the iris locking system 26 described further herein.

Now referring to FIG. 3, it can be appreciated that the casing 22 defines and interior chamber and in one form comprises a base region 42 and a panel region 44. In one form, the panel region 44 is pivotally connected at the pivot location 46. In one form, the pivot location 46 is comprised of an internal hinge 48 which is hidden from view and the surrounding surfaces 50 and 52 of the panel region 44 and the base region 42 respectively are substantially continuous, creating a smooth exterior housing. As shown in FIG. 3, the internal pin 47 is positioned in the interior chamber portion of the casing 22.

Figure 9:
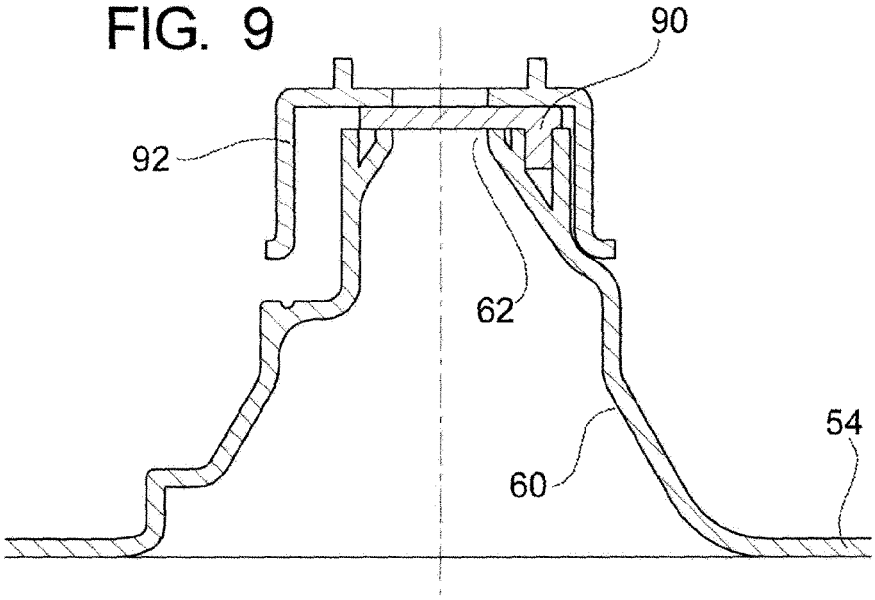
FIG. 9 shows a sectional view taken along line 9-19 of FIG. 8 showing the orientation of the components in one form.

The casing 22 further comprises a faceplate 54 which in one form mounts to the base region 42 by way of the snap connectors 56 and 58. The base plate 54 in one form allows for a different type of material and more modular configuration to house the iris adjustment system 24 and the iris locking system 26 which are shown by way of example in detail herein below. It should be noted that the central region 60 of the faceplate is of a frustoconical nature, having a smooth fillet-like interface to the upper surrounding surface 62, which is configured to support the lower surface of the paper towel roll 36. As shown in FIG. 9, there is a cross-sectional view of the faceplate 54 where the central region 60 comprises the frustoconical-like surface to channel the paper towel members up to the central opening 62.

Figure 4:
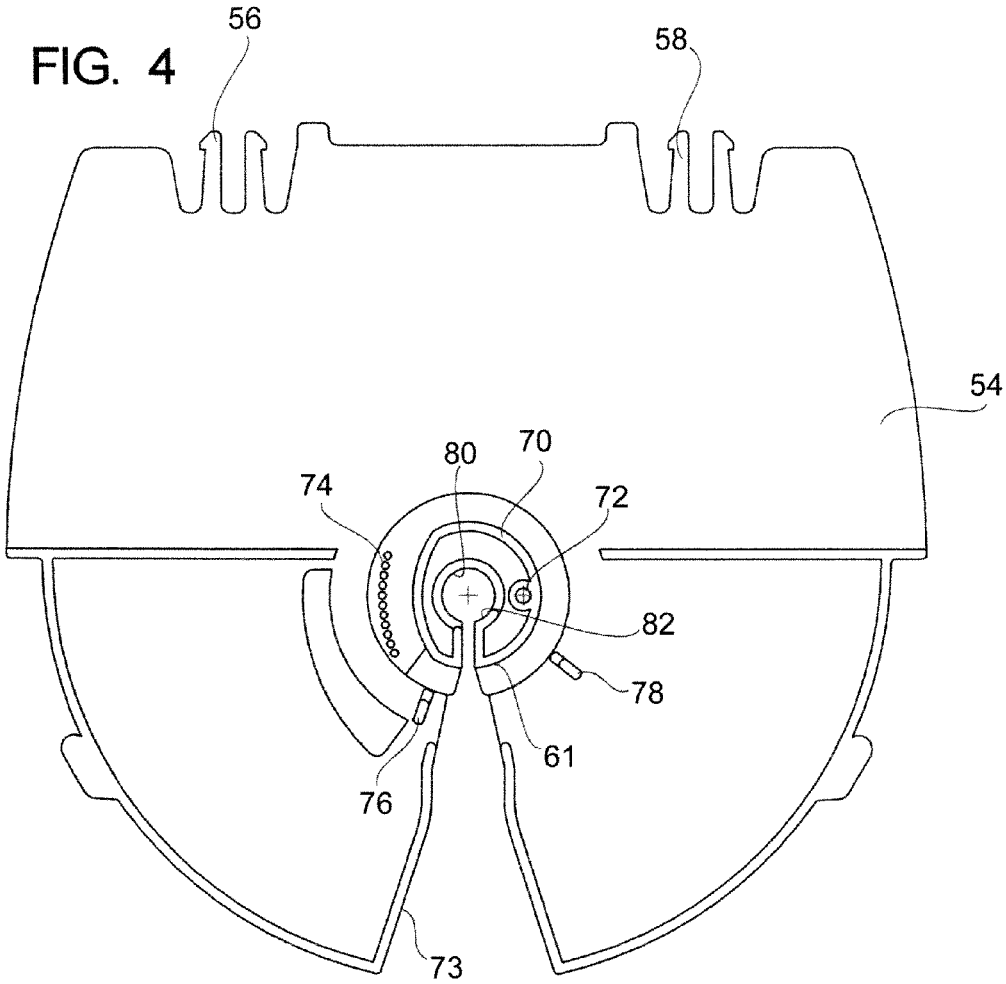
FIG. 4 shows a bottom view of the base plate member which is the lower portion of the casing which in one form is a modular unit attached therein.

As shown in FIG. 4, there is a base plate where the underside portion is exposed. As shown in the bottom protruding portion 61, there is a surface 70 which is an outer surface which in part can be conical to allow rotation of the components and in particular the shroud member 92 of the iris locking system 26.

The surface 72 in one form comprises a cylindrical opening to engage the pivot extension 94 of the iris adjustment member 90 of the iris adjustment system.

As shown in one form, there is a plurality of lock positions where the first form of the description of the iris adjustment system as is a manual one and a lock extension 96 of the iris adjustment member is configured to engage one of the lock positions 74. Of course, other lock mechanisms can be employed.

Further shown in FIG. 4 in the lower portion are stopping members 76 and 78 which are configured to engage the trailing and leading stop surfaces 130 and 132 of the shroud member 92 described further herein. The access slot 73 is defined in the central lateral transverse front region.

Of course, it can be appreciated that a plurality of methods, components and assemblies can be used to have the iris adjustment system. Disclosed above and further herein are examples of carrying out the broader concept which is protected by way of the claims herein.

As a final note with regard to the base member 54, the internal surface 80 comprises in part a portion of the iris as shown in FIG. 4. In one form, the transverse front region 82 will provide a portion of the iris along with the adjustable iris surface 98 of the iris adjustment member 24 as well as, in one form, a portion of the shroud 92.

With the foregoing description in place with regard to the base member, there will now be a description of the two components which in part comprise the iris adjustment system and the iris locking system. The first component to be described is the iris adjustment member 90 followed by a description of the shroud 92 (which in part comprises the iris locking system 26).

Figure 5:
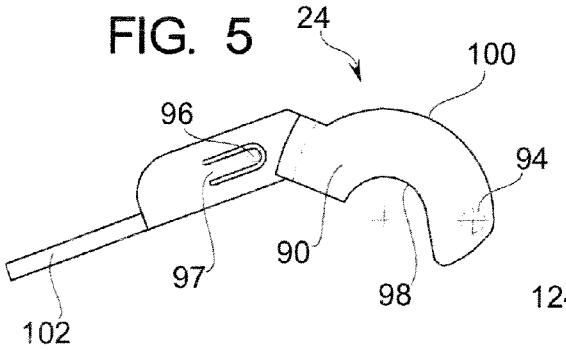
FIG. 5 shows a portion of the iris adjustment system where in this form a manual iris adjustment system is utilized.

As shown in FIG. 5, there is an iris adjustment member 90. In this form, the member 90 is a manual adjust embodiment, but an automatic adjust embodiment will described further herein with reference to FIGS. 13-19. The iris adjust member 90 comprises a pivot extension 94 and a lock extension 96. Further, the iris adjustable surface 98 is provided in the transverse rearward portion of the towel iris, which is repositioned with respect to the transverse front region 82 of the base plate 54 as shown in FIG. 4. There is further a circumferential region 100 as shown in FIG. 5 and an adjustment arm 102.

Figure 10:
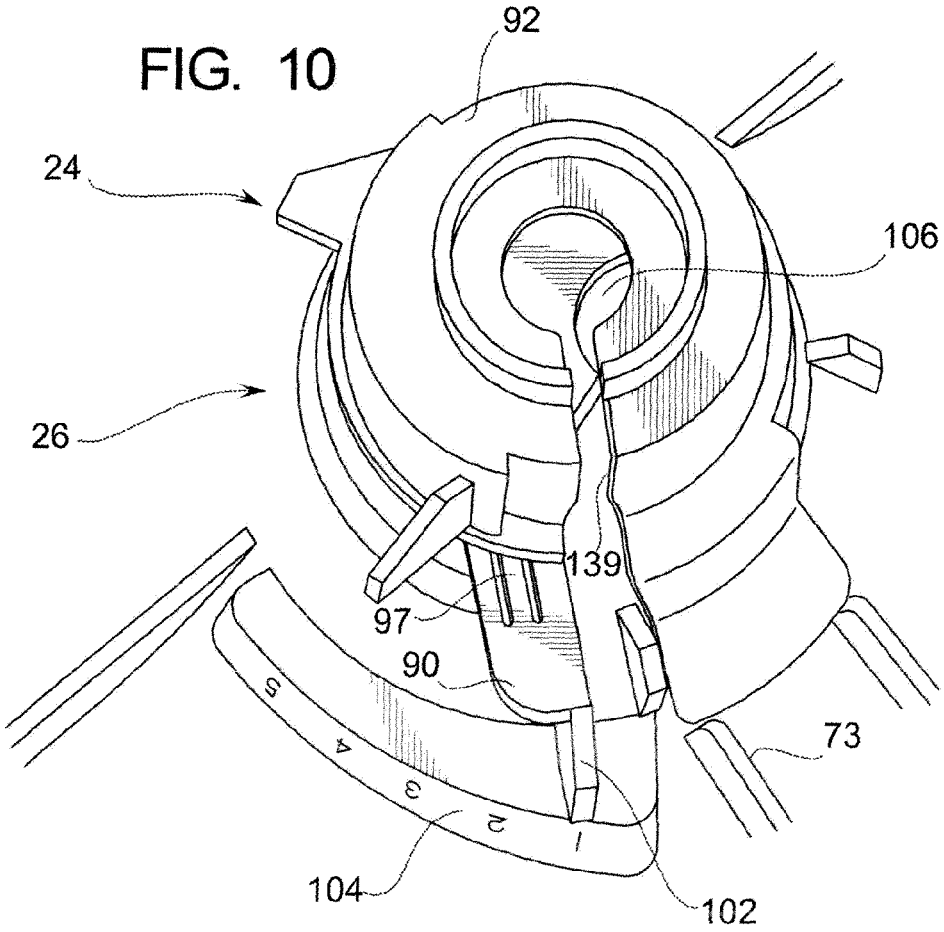
FIG. 10 shows an orthogonal view were the iris locking system is in a locked orientation and in this form, an enclosing surface of the shroud is rotated to lock the portion of the iris which is one form is the transverse front portion thereof.

Now referring to FIG. 7, it can be appreciated that in an operating position, the pivot extension 94 is received within the cylindrical opening defined by the surface 72 of the base plate so the iris adjustment member 90 is pivotally attached thereto. In this form, the adjustment arm 102 can be manually adjusted such that the lock extension 96 is springingly attached to the arm by way of a cantilevered arm 97. As shown in FIG. 10, the isometric view illustrates the adjustment arm 102 being positioned at one of the prescribed locations indicated by the designations at 104 which in one form are numeric designations incrementing to indicate a prescribed cross-sectional area of the towel iris indicated at 106.

Now referring back to FIG. 6, there is shown a shroud 92 which in one form comprises the iris locking system 26. The shroud has an outer peripheral region 120 and an inner peripheral region 122. The internal surface 124 has a front transverse portion which is configured to form, in part, the towel iris 106 as shown in FIG. 10. There is further a positioning latch 128 having a trailing stop surface 130 and a leading stop surface 132. The engagement latch 136 is shown where the engagement surface 138 is provided to have torque placed thereon to rotate the shroud 92 into a closed orientation. It can be seen in FIG. 8 that the shroud 92 is positioned around the iris adjustment member 90, in one form.

Figure 11:
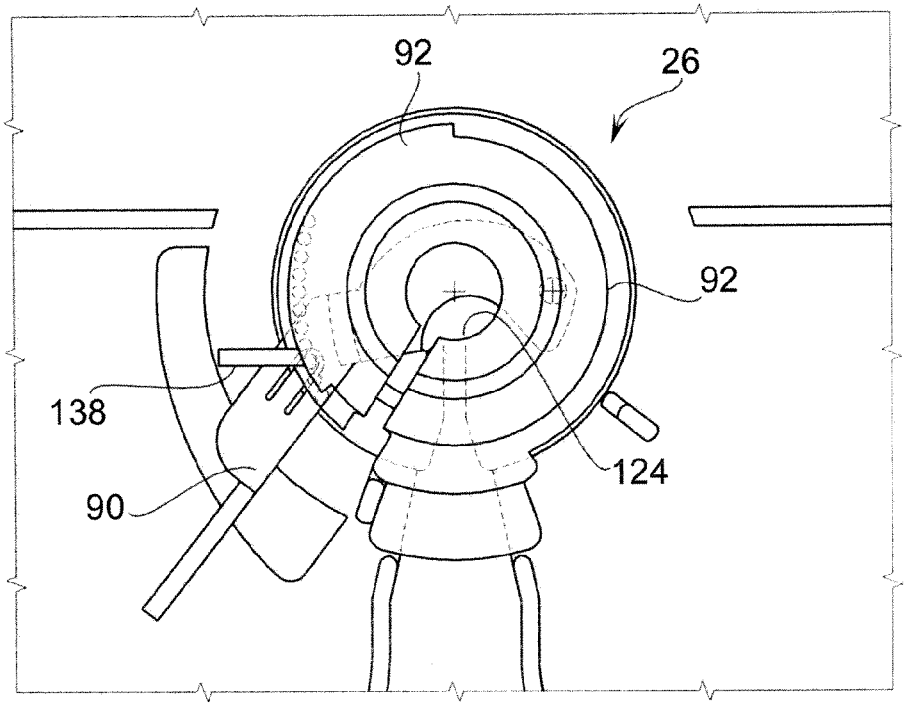
FIG. 11 shows a bottom view where the shroud is in a locked orientation and the iris adjustment member is in a reduced iris sized orientation.
Figure 12:
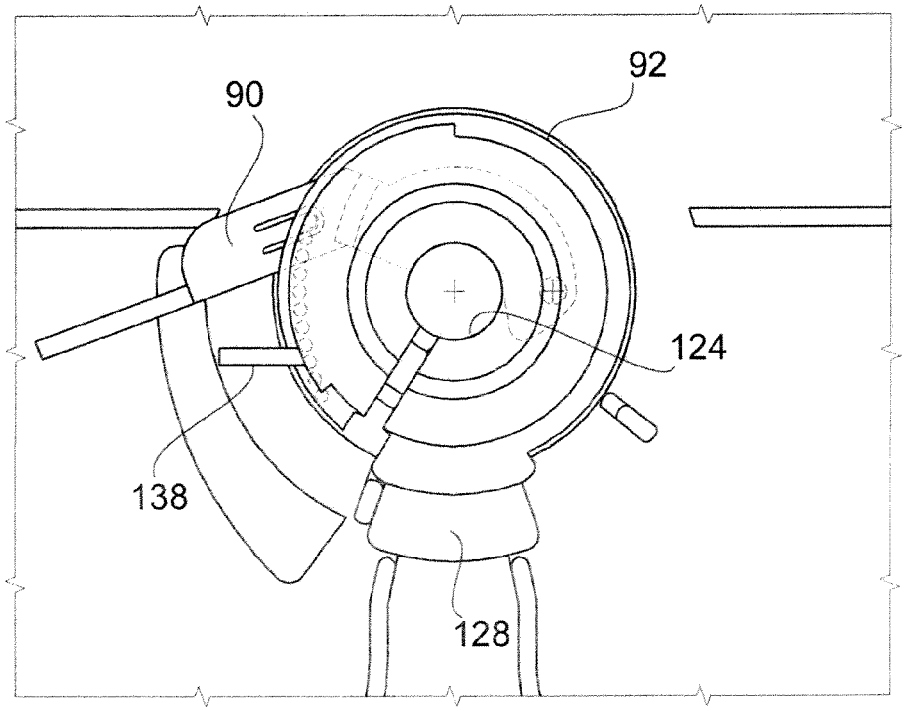
FIG. 12 is another bottom view where the shroud member is in the locked orientation and the iris adjustment member is in an increased iris sized orientation.

Now referring to FIG. 11, the iris locking system 26 as shown where the shroud 92 is rotated to a locked orientation. In one form, the engagement surface 138 is biased to the locked orientation either manually or by an extension engagement surface in the panel region 44 (the panel region 44 is shown in FIG. 3).

Figure 20:
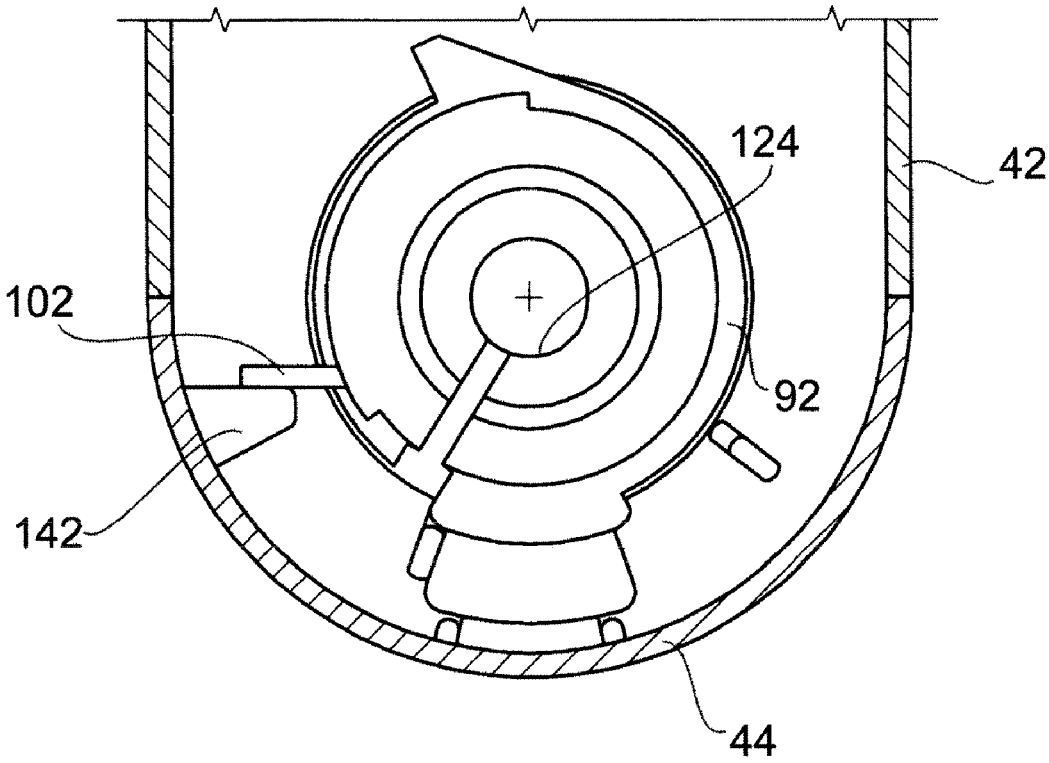
FIG. 20 shows a cross sectional view taken from line 20-20 of FIG. 1 showing the locking mechanism where the panel region of the casing rotates the locking mechanism to a closed orientation.

As shown in FIG. 20, there is a cross-sectional view taken at line 20-20 of FIG. 1. It can be appreciated that the panel engagement member 142 is configured to engage the engagement latch 102 to automatically bias the shroud 92 to the closed and locked orientation when the casing 44 is in an enclosed position with respect to the base region 42 as shown in FIG. 3 (as well as in FIG. 1 in the environmental view).

FIG. 9 shows a cross-sectional view taken at line 9-9 of FIG. 8, and it can be seen in one form how the shroud 92 is encompassed around the iris adjustment member 90.

Figure 6:
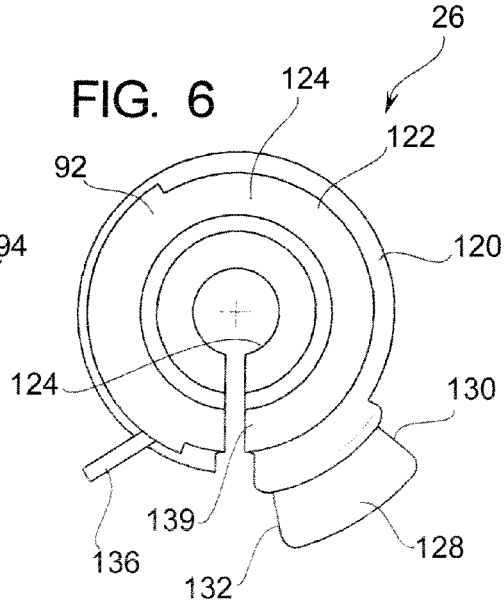
FIG. 6 shows a portion of the iris locking system which in one form is a shroud which rotates upon having a panel region of the casing rotatably closing to the base region of the casing.

As shown in FIG. 6, the transverse front surface 124 is configured to discontinue communication with the towel iris 106 (see FIG. 10) and the access slot 73 of the casing as shown in FIG. 4, which in one form is comprised of the base plate 54. Of course, the access slot 73 is defined by the lateral adjacent surfaces thereof. It should be noted that other methods of providing a transverse front surface can be employed. The surface defining the slot opening 139 as shown in FIGS. 6 and 10 of the iris locking system has the locked orientation (See FIG. 10) where the slot opening is not in alignment with the access slot 73 of the casing, which in one form is a part of the base plate 54. As shown in FIG. 8, the surface defining the slot opening 139 is in alignment with the access slot 73 to allow the towel member to have access therein when, for example, a towel is being loaded above the lower portion of the paper towel dispenser 20. The term to discontinue communication between the towel iris 106 and the access slot 73 is generally defined as providing a sufficient amount of discontinuity between these areas such that when a paper towel is pulled downwardly, as shown in FIG. 1, the transverse front surface 124 will not allow access at the front portion of the access slot 73. Of course, not providing communication generally means that in the direction of pull, or the substantial vertical direction perhaps with a slight transverse forward angle, there is a sufficient amount of the surface 124 to engage the paper towel for the operation described initially in the specification when discussing the general nature of the center pull towel mechanism.

With the foregoing description in place of the first embodiment, there will now be a description of another form. In this form, the adjustment of the towel iris 106 is executed automatically by way of a biasing member 275. To aid in the description, similar numerals which are incremented by 200 (i.e. will be preceded with a numeral "2" when referring to numbers with two significant digits) will designate similar components for the first embodiment.

Figure 13:
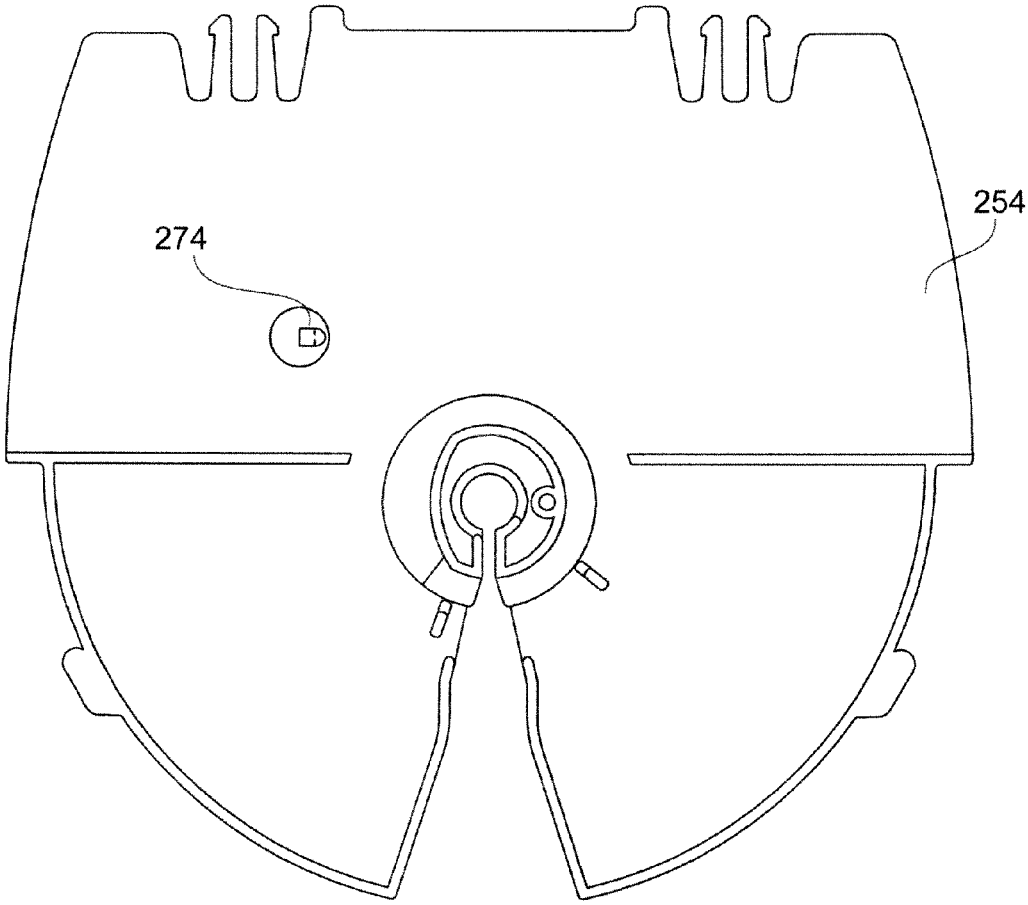
FIG. 13 shows the base plate of another embodiment.
Figure 16:
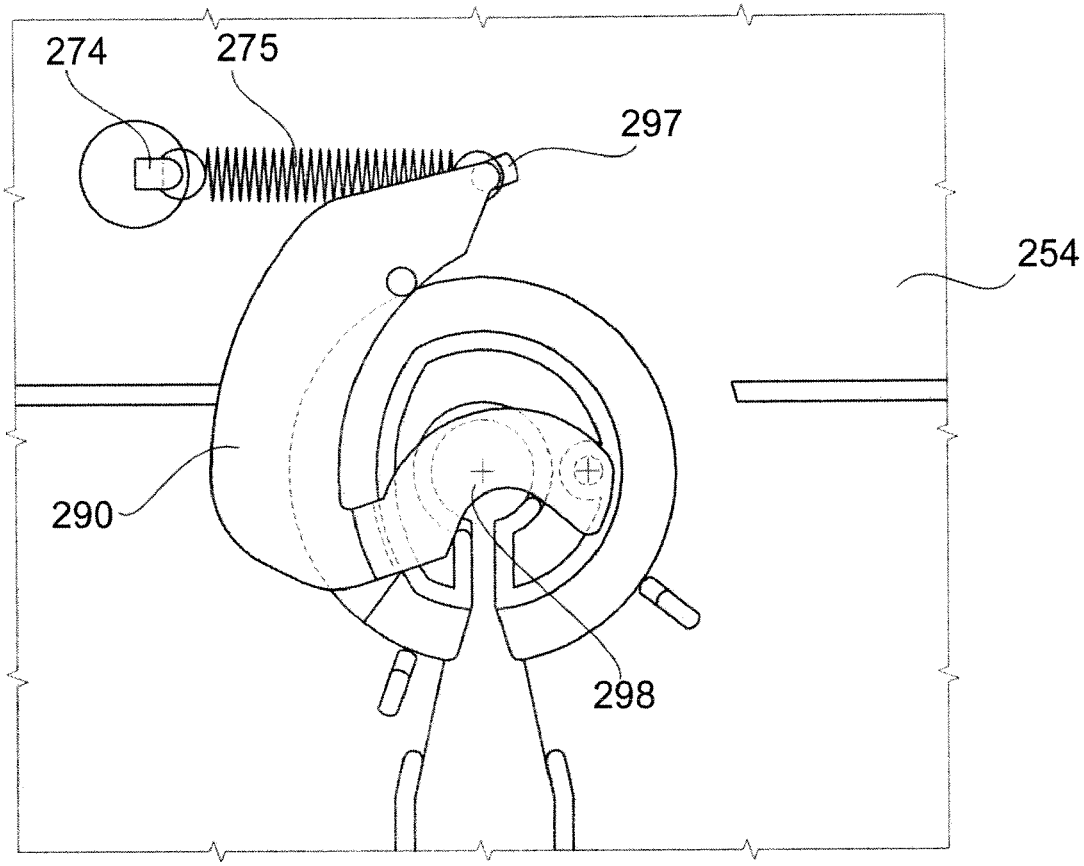
FIG. 16 shows a bottom view of the iris adjustment member in a more closed orientation where the biasing members such as a helical string, biases the member to the reduced iris size orientation.

As shown in FIG. 13, there is a faceplate 254 which is similar to the base plate as shown in FIG. 4, except the biasing attachment location 274 is provided which attaches to the biasing member 275 as shown in FIG. 16. The shroud 292 is similar to the shroud in FIG. 6, however a rotational biasing surface 293 is provided. In the similar form, the engagement latch 336 is provided to rotate the shroud member 292 to a close and locked orientation in a similar manner as described above with reference to FIG. 20.

Figure 14:
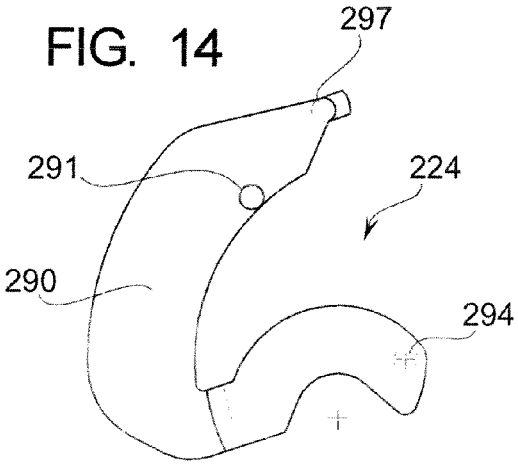
FIG. 14 shows a second form of an iris adjustment system having an automatically adjustable iris adjustment member.
Figure 15:
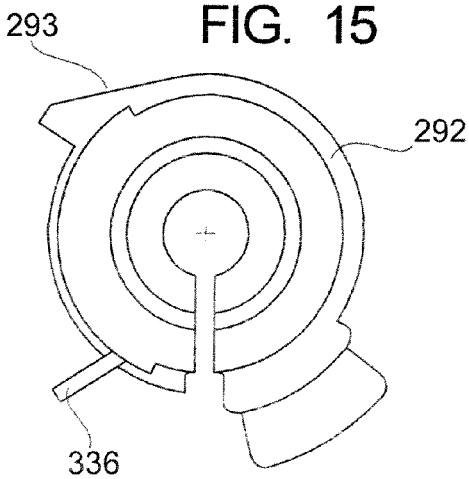
FIG. 15 shows the shroud member which comprises in part the iris locking system.

Now referring to FIG. 14, there is shown another form of the iris adjustment system 224 where the iris adjustment member 290 is an automatic adjusting iris member. The torque transfer surface 291 in one form is a vertically extending peg member to engage the rotational biasing surface 293 as shown in FIG. 17 in the assembled view where the torque transferring surface 291 is an engagement with the rotational biasing surface 293 to bias the shroud 292 to the unlocked orientation.

Figure 17:
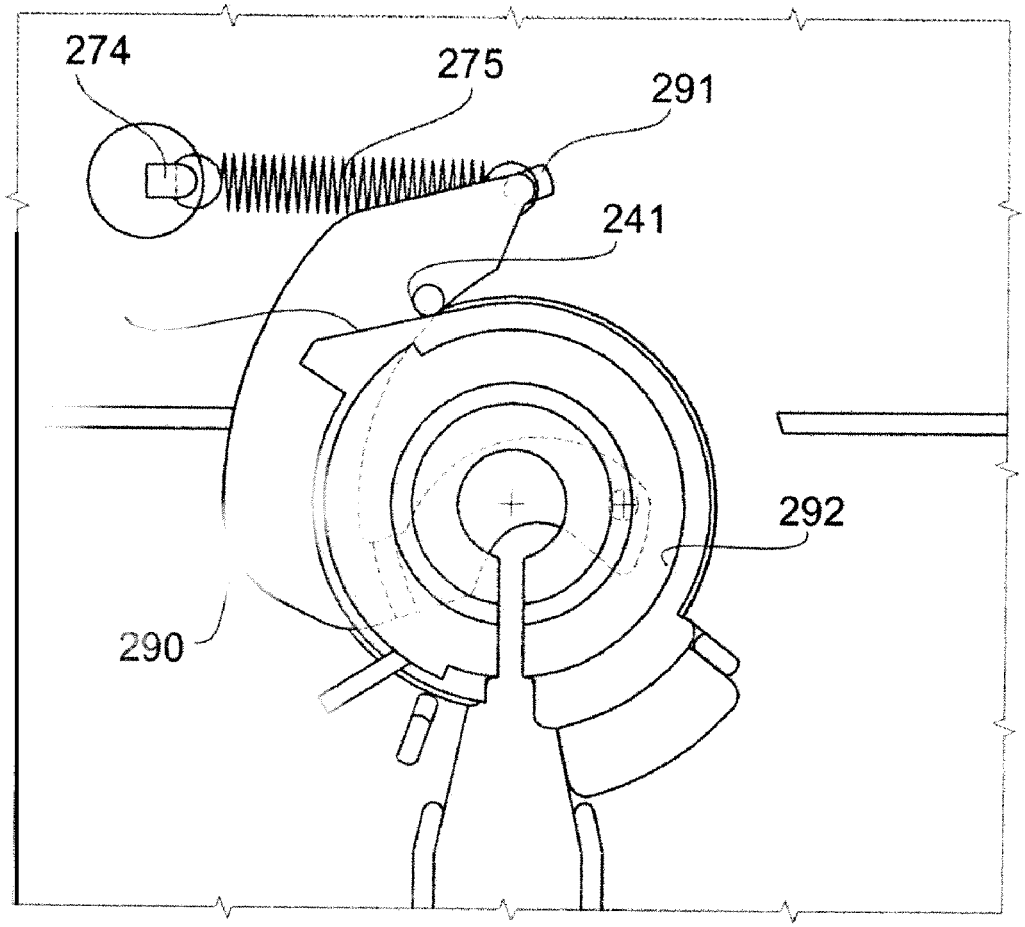
FIG. 17 shows the assembly with the shroud member positioned around a portion of the iris adjustment member.
Figure 18:
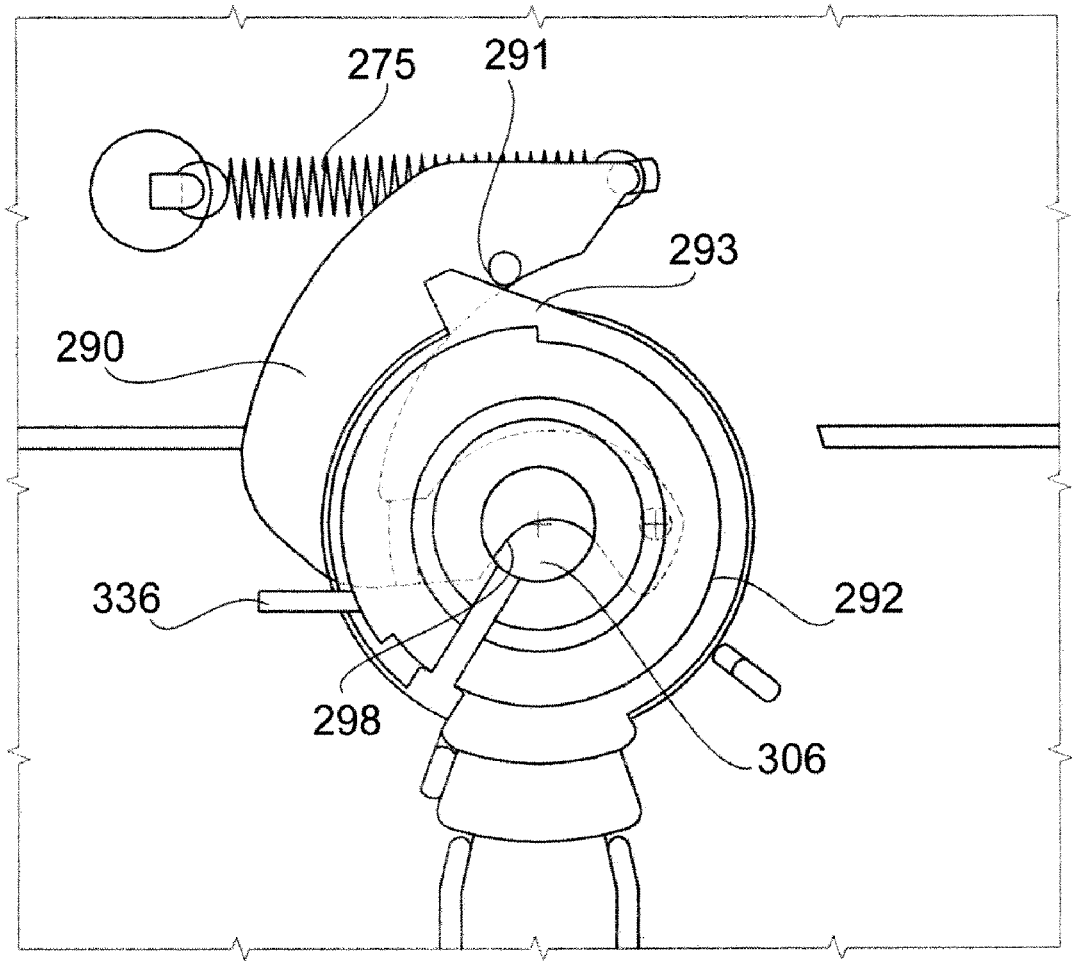
FIG. 18 shows the shroud member in a locked orientation which a preferred form occurs when the panel region of the casing which rotates outward is in engagement with the base region of the casing where the a portion of the panel region will engage the engagement latch of the shroud member.

Referring back to FIG. 14, the biasing connecting region 297 is provided, and as shown in FIGS. 16 and 17 the biasing member 275 is connected thereto.

It should be noted that the connection of the biasing member 275 is such that a torque is supplied around the pivot extension 294 to bias the iris adjustment member 290 to the reduced iris size orientation as shown in FIG. 17.

FIG. 16 shows the iris adjustment member 290 positioned upon the base plate 254. Further, FIG. 17 shows a shroud member 292 positioned over the iris adjustment member 290. Now referring to FIG. 18, it can be appreciated in the locked orientation that the shroud 292 is rotated and the engagement latch 336 is rotated by engaging the panel engagement member 142 as shown in FIG. 20. This rotation partially opens the towel iris 306 and the biasing member 275 which is in one form a tension helical spring that is placed in a higher stored energy state such that the rotational biasing surface 293 is engaging the torque transfer surface 291 of the iris adjustment member 290. Therefore, it can be appreciated that in this form, the biasing member 275 not only biases the iris adjustment member 290 to a reduced surface area orientation of the towel iris 306, but further provides a force to reposition the shroud 292 into an unlocked orientation, as shown in FIG. 17.

Figure 19:
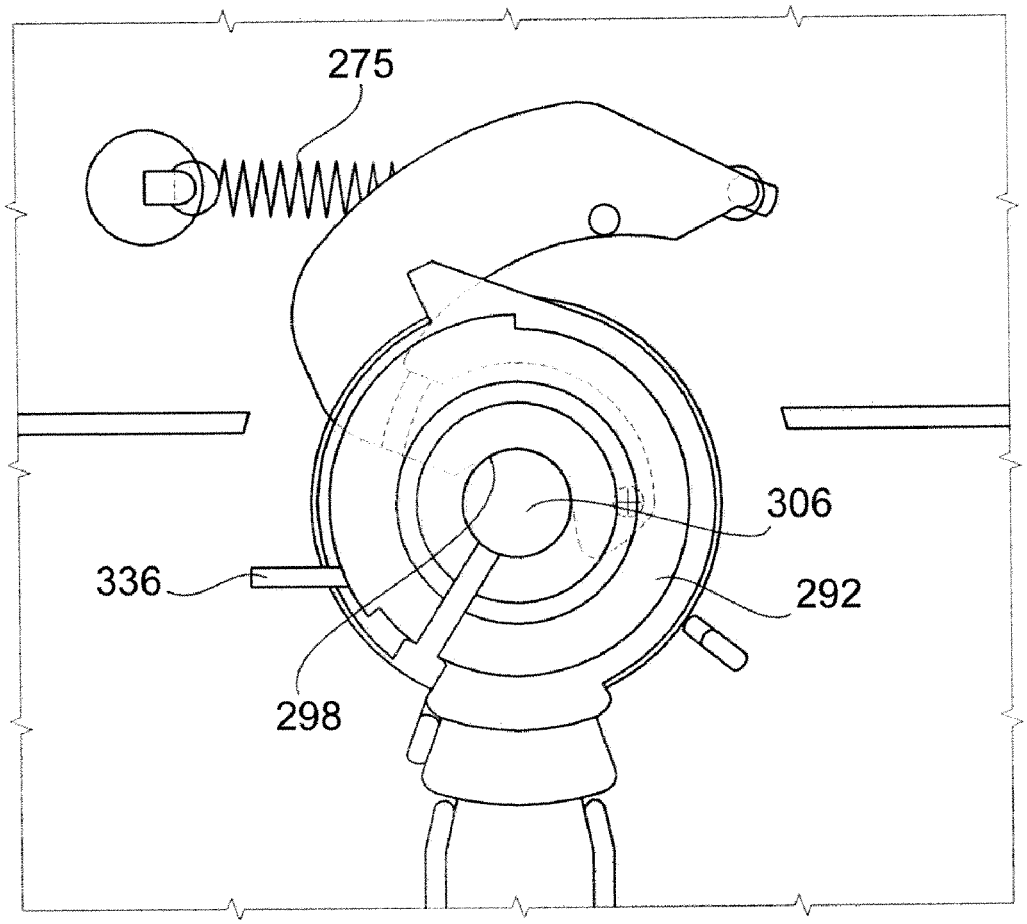
FIG. 19 shows the biasing member in a higher stored energy state where the iris adjustment member is in an orientation increasing the size of the iris.

Now referring to FIG. 19, it can be appreciated that the towel iris 306 is in a maximum open orientation. This view is used as an example to show that a force applied upon the iris adjustment surface 298 automatically adjusts the towel iris size in the cross-sectional area thereof indicated at 306. It can be appreciated that the biasing member 275 is at a maximum stored orientation state in this configuration. In a view such as FIG. 19, presumably a very thick paper towel cross-sectional area is passing through the opening and the biasing member 275 transfers a certain amount of frictional force through the surface 298 to the outer surface of the towel section 34 which is shown by way of example in FIG. 3.

Figure 21:
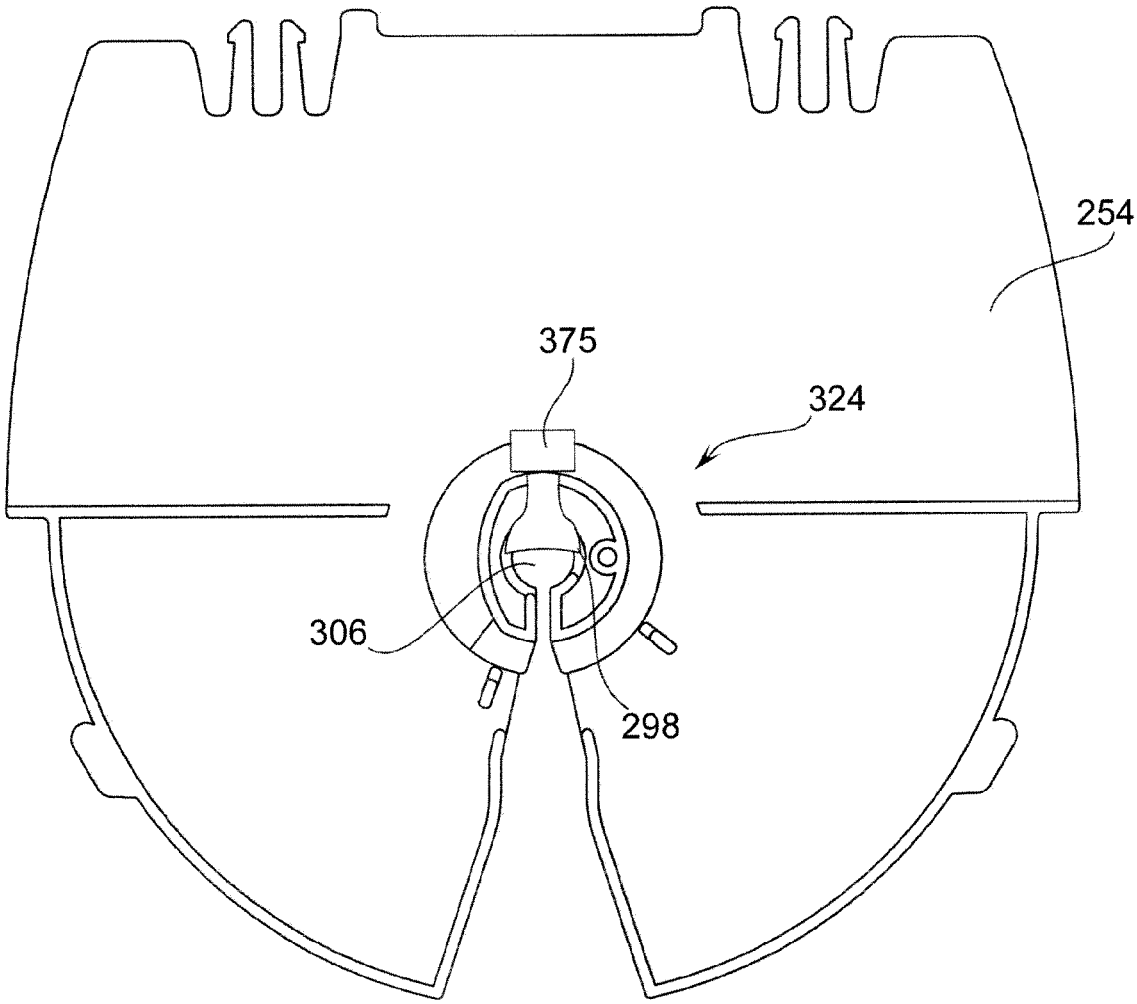
FIG. 21 shows another form of an adjustment system.

As shown in FIG. 21, there is another iris adjustment system 324 where an iris adjustment surface 298 is positioned in the transverse rearward region with respect to the surfaces defining the towel iris 306. The iris adjustment system 324 has a biasing member 375 which is configured to reposition the iris adjustment surface 298 in a transverse forward orientation. This embodiment illustrates the general principle of having the iris adjustment surface 298 positioned in the transverse rearward portion attached to the base plate 254, which in one form is a part of the base region of the casing. Therefore, referring back to FIG. 1, it can be appreciated that when an individual 30 is pulling a towlette 32, in most situations, the towlette will be pulled toward the transverse front portion as indicated by the vector 16. Therefore, the general direction of pull is opposed to the iris adjustment surface 298 described above, whereby the force vector of pulling the towlette 32 in a slight traverse forward direction will not affect the iris opening. As described above, in one form the iris locking system provides the front transverse surface, which is repositionally connected to the base region and configured to allow access to the towel iris when the repositional region of the casing is in the open orientation. Of course, the surface 124 (see FIG. 11) can be provided in a plurality of forms other than that shown by example above.

While the present invention is illustrated by description of several embodiments and while the illustrative embodiments are described in detail, it is not the intention of the applicants to restrict or in any way limit the scope of the appended claims to such detail. Additional advantages and modifications within the scope of the appended claims will readily appear to those sufficed in the art. The invention in its broader aspects is therefore not limited to the specific details, representative apparatus and methods, and illustrative examples shown and described. Accordingly, departures may be made from such details without departing from the spirit or scope of applicants' general concept.

We claim:

1. A towel dispenser comprising:

a) a casing having a mounting portion and an interior chamber, the casing having a base region and a panel region movably attached to the base region, the base region further having a surface defining an access slot, b) an iris adjusting system comprising an iris adjustment member comprising an adjustable iris surface which defines in part a towel iris, the iris adjustment system operatively configured to reposition the iris adjustment member to reposition the adjustable iris surface to change the cross-sectional area of the towel iris from within the interior chamber of the casing, c) an iris locking system including a front transverse surface portion repositionally connected to the base region of the casing and a surface defining a slot opening, wherein i) the surface defining the slot opening comprises an open orientation where the slot opening is in alignment with the access slot of the casing to provide lateral access to the towel iris, and ii) the transverse front surface comprises a closed orientation to discontinue communication between the access slot of the casing, and the towel iris where the transverse front surface is repositioned by way of an engagement surface of the iris locking system which is configured to engage the panel region of the casing and rotate the transverse front surface to the closed position with respect to the base region of the casing.

2. The towel dispenser as recited in claim 1 where the iris adjustment member is pivotally attached to the casing and a biasing member biases the iris adjustment member so the towel iris has a minimum cross-sectional area.

3. The towel dispenser as recited in claim 2 where the iris adjustment member is pivotally attached to the base region of the casing and a shroud defines the transverse front surface and substantially encases the iris adjustment member in the circumferential region thereof and an engagement latch of the shroud defines the engagement surface and is operatively configured to engage the panel region of the casing when the panel region is in a closed position with respect to the base region.

4. The towel dispenser as recited in claim 3 where the iris adjustment member comprises a biasing surface which is configured to engage a receiving surface of the shroud where the biasing surface of the iris adjustment member places an opposing force against the force of the engagement latch from the panel region of the casing when the panel region is in the enclosed position with respect to the base region of the casing.

5. The towel dispenser as recited in claim 1 where the orifice locking system comprises a shroud a positional latch to limit the rotational travel.

6. The towel dispenser as recited in claim 5 where the panel region is configured to engage the engagement latch of the shroud which rotates the shroud opening to the closed orientation when the panel region of the casing is in engagement with the base region to form an enclosed position.

7. The towel dispenser as recited in claim 6 where the panel region is pivotally attached to the base region.

8. The towel dispenser as recited in claim 1 where the base region is hingedly attached to the panel region and the hinge pin member is contained within an inner chamber portion of the casing.

9. The towel dispenser as recited in claim 8 where the outer surface of the base region and panel region are substantially continuous where they are hingedly attached to one another.

10. The towel dispenser as recited in claim 7 where the surface defining the slot opening is facing a transverse outward region.

11. The towel dispenser as recited in claim 1 where the iris adjustment system comprises a lock extension at an opposing region of a pivot extension to pivotally connect the iris adjustable member.

12. A towel dispenser configured to distribute a roll of towels having towel sections separated by perforations, the towel dispenser comprising:

a) a casing having a central chamber and a base region and a panel region, b) an iris adjustment system having an iris adjustable surface defining in part a towel iris and configured to reposition to adjust a cross-sectional area of the towel iris from an actuator from within the internal chamber of the casing, c) an iris locking system having a transverse front surface where an engagement surface of the iris locking system is configured to engage the panel region of the casing when the panel region is in an enclosed position with respect to the base region so as to reposition the transverse front surface of the iris locking system to form a portion of the towel iris in a transverse front portion of the towel iris where the iris adjustable surface is positioned in a transverse rearward portion of the towel iris, d)wherein the iris locking system includes a front transverse surface portion repositionally connected to the base region of the casing and a surface defining a slot opening, wherein i) the surface defining the slot opening comprises an open orientation where the slot opening s in alignment with the access slot of the casing to provide lateral access to the towel iris, and ii) the transverse front surface comprises a closed orientation to discontinue communication between the access slot of the casing, and the towel iris where the transverse front surface is repositioned by way of an engagement surface of the iris locking system which is configured to engage the panel region of the casing and rotate the transverse front surface to the closed position with respect to the base region of the casing.

13. The towel dispenser as recited in claim 12 where a surface defining an access slot is a part of the base region and configured to have a towel section of the roll of towels be positioned therethrough toward an inner surface and the transverse front surface cuts off communication from the towel iris to the access slot of the base region.

14. The towel dispenser as recited in claim 13 where the surface defining the access slot is part of a base plate which is fixedly and removably attached to the base region.

15. The towel dispenser as recited in claim 14 where the iris locking system is comprised of a shroud where an engagement latch defines the engagement surface.

16. The towel dispenser as recited in claim 15 where a positioning latch is configured to engage first and second stop surfaces for a predefined amount of rotation of the shroud.

17. The towel dispenser as recited in claim 12 where the iris adjustable surface is a part of an iris adjustment member that is pivotally attached to the base region and a biasing member biases the iris adjustment surface toward a minimum cross-sectional area of the towel iris.

18. The towel dispenser as recited in claim 17 where a biasing connection region of the iris adjustment member transfers force to a rotational biasing surface of the shroud to bias the shroud toward an unlocked orientation.

19. The towel dispenser as recited in claim 18 where the shroud is positioned around a lower extension of a base plate which is a part of the base region of the casing and the shroud is configured to rotate therearound where the transverse front surface is an interior surface of the shroud.

20. The towel dispenser as recited in claim 12 where the iris adjustment system is comprised of an iris adjustment member which is repositioned manually to adjust the towel iris open cross-sectional area of the towel iris.

21. The towel dispenser as recited in claim 12 where the transverse front surface is positioned in a transverse front region of the towel iris opening and is substantially static.

22. The towel dispenser as recited in claim 21 where the iris adjustable surface of the iris adjustment system is positioned in a transverse rearward portion of the towel iris opening and defining the transverse rearward portion thereof and repositions substantially in the transverse direction.

23. The towel dispenser as recited in claim 12 where the towel iris is comprised of a base member, the iris adjustable surface and the transverse front surface where the base member forms a portion of the base region of the casing.

24. The towel dispenser as recited in claim 23 where the iris adjustment system is attached to the base member.

25. A method of dispensing a paper towel through a center pull towel arrangement where a lower end portion extends from a center portion of a paper towel dispenser, the method comprising:

a) grasping the lower extended region of a paper towelette which is an end portion towelette of a roll withdrawn from the center internal cylindrical region of the paper towel roll, which extends through a towel orifice in the lower portion of the paper towel dispenser, b) providing an iris adjustment system where an iris adjustment member having an adjustable iris surface positioned in a transverse rearward portion with respect to the paper towelette, and the transverse rearward portion providing a frictional force acting upon the paper towelette where the adjustable iris surface is configured to reposition at least a portion of the iris adjustment member in the transverse direction and supply the transverse forward force upon a transverse front surface which is a part of a locking member, the locking member being configured to have an open orientation where transverse access to the towel iris is provided to the transverse front portion of the paper towel dispenser, the transverse front surface further having a closed orientation where the transverse front surface discontinues transverse communication to the towel iris from the transverse front portion of the paper towel dispenser, c) repositioning a front portion of a casing which is movably attached to a base portion of the casing of the paper towel dispenser, whereby repositioning the front portion of the casing to an enclosed position adjacent to the base region repositions the locking member of the transverse front surface from the open orientation to the locked orientation.

26. The method as recited in claim 25 where a user pulls upon the lower end of the paper towel by partially pulling in the transverse front direction or by placing an increased amount of normal force upon the transverse front surface.

27. The method as recited in claim 26 where the iris adjustable surface re-positions in the transverse forward direction automatically when the cross-sectional surface area of the rolled towelette being dispensed changes, thereby causing a greater average normal frictional force upon the towelette than a constant diameter towel cross-sectional open area of the total iris.

28. The method as recited in claim 27 where a biasing member is provided to bias the iris adjustable surface to provide a smaller cross-sectional open area of the towel iris and a towelette passing through the towel iris changes the cross-sectional open area of the towel iris with respect to the diameter of the folded paper.

29. The method as recited in claim 28 where the biasing member further provides a rotational torque upon the lock member to bias the lock member so the iris locking surface does not obstruct the transverse front open access to the towel iris, and the closing of the panel region with respect to the base region engages the lock member to reposition the transverse front surface to a closed orientation, thereby increasing the stored energy in the biasing member.

* * * * *